United States Patent [19]

Landwehrkamp et al.

[11] Patent Number: 4,501,221

[45] Date of Patent: Feb. 26, 1985

[54] THREAD PARAFFINING DEVICE EMPLOYING A THREAD ELEMENT

[75] Inventors: Hans Landwehrkamp, Lenting; Gottfried Schneider, Ingolstadt, both of Fed. Rep. of Germany

[73] Assignee: Schubert & Salzer Maschinenfabrik Aktiengesellschaft, Ingolstadt, Fed. Rep. of Germany

[21] Appl. No.: 513,996

[22] Filed: Jul. 14, 1983

[30] Foreign Application Priority Data

Jul. 31, 1982 [DE] Fed. Rep. of Germany ..... 3228642

[51] Int. Cl.[3] ..... B05C 1/06

[52] U.S. Cl. ..... 118/78; 427/11

[58] Field of Search ..... 118/78; 427/11

[56] References Cited

U.S. PATENT DOCUMENTS 3,479,988 11/1969 Trost et al. ..... 118/78

4,345,542 8/1982 Hauner ..... 118/78

*Primary Examiner*—John P. McIntosh

*Attorney, Agent, or Firm*—Dority & Manning

[57] ABSTRACT

A thread (3) paraffining device employing a paraffin element (2) which is resiliently biased against a stop rail (6). The stop rail 6 extends transversely to the thread path direction and is arranged on one half of the end face (20) of the paraffin element (2) remote from the thread contact side. The paraffin element (2) has a diameter of at least 50 mm.

13 Claims, 3 Drawing Figures

THREAD PARAFFINING DEVICE EMPLOYING A THREAD ELEMENT

BACKGROUND OF THE INVENTION

This invention relates to a thread paraffining device employing a paraffin element which is resiliently biased and slidably mounted, towards a thread path and a stop, on a rotary polyhedral bolt, the axis of which is oriented substantially at right angles to the thread path between a delivery station and a take-up device.

In known paraffining devices of this type (German Auslegeschrift No. 2,105,558 and German Utility Model 7,927,734), a stop is arranged on one or both sides of the end face of the paraffin element, laterally of the traversing region of the thread. Furthermore, the paraffin element is supported only along a partial length by the polyhedral bolt supporting and driving it, in order to prevent with certainty the polyhedral bolt from projecting beyond the end face of the paraffin element and coming into contact with the yarn. Due to the deadweight of the paraffin element, a tilting moment then appears, by which particularly a large paraffin element drops with its side facing the yarn. The guiding female polyhedron in the paraffin element is then knocked out so that the tilting moment increases progressively and the entrainment of the paraffin element by the polyhedral bolt deteriorates progressively. This tilting moment is also generally intensified by the stop or stops, which engage the lower half of the end face of the paraffin element for the generally customary thread path movements from the bottom upwards.

The stop or stops arranged laterally of the traversing region greatly restrict the traversing angle, exceeding which causes the thread to enter the region of the stop or stops and thus cause the paraffining process to be impaired.

SUMMARY OF THE INVENTION

It is, therefore, the aim of this invention to construct a paraffining device of the initially stated type so that a uniform rotation of the paraffin element and a uniform paraffining of the thread is ensured.

This aim is achieved, according to the invention, in that the stop is constructed as a stop rail extending transversely to the thread path direction, which is arranged on that half of the end face of the paraffin element remote from the thread contact side. The measure that the stop rail extends transversely to the thread path direction avoids with certainty the possibility of the thread adhering temporarily to the stop during its traversing movement, so that any non-uniform application of paraffin to the thread dictated by this factor is excluded. Since the retention of the thread by the stop is excluded due to its orientation, it is impossible for reduction to occur solely in the marginal region of the end face, simultaneously leaving the central region of the end face of the paraffin element; by contrast, uniform reduction of the paraffin element across the entire surface of its end face is ensured. The measure that the stop rail is arranged between the end face of the paraffin element and the thread also ensures that clamping of the thread between stop and paraffin element cannot occur.

The object of the invention achieves that the moments or forces acting upon the paraffin element are substantially self-compensating, so that knocking-out of the female polyhedron in the paraffin element, which is adapted to the polyhedral bolt, does not occur either.

The uniform reduction of the paraffin element achieved and the formation of a counter-moment to the tilting moment generated by gravity, create the necessary conditions for the use of paraffin elements, the size of which is several times greater than that of hitherto customary paraffin elements.

In order to enlarge the contact surface between stop rail and paraffin element and thereby reduce the specific pressure per unit area, it is provided as a convenient further development of the subject of the invention that the stop rail exhibits a enlargement in the form of a metal sheet which extends to the edge of the paraffin element. This enlargement enlarges the contact surface of the stop rail on that side of the thread path on which the thread is not in contact with the paraffin element in any case and produces gentle sliding on the rotating paraffin element.

The enlargement advantageously overhangs the paraffin element somewhat at its circumference so that the paraffin element can never come into contact with the outer edge of the stop rail. Also in order to make it impossible for the inner edge of the stop rail to cut into the paraffin element, the enlargement is inclined towards the peripheral edge of the paraffin element. As an advantageous further development, the enlargement is rounded towards the paraffin element on its side facing the polyhedral bolt. Consequently, there is no sharp edge of the stop rail which can cut into the paraffin element, so that the initiation of contact between paraffin element and stop rail occurs extremely gently.

The stop rail is advantageously constructed as a thread tension compensating yoke so that a separate thread tension compensating yoke is unnecessary.

Whereas, with the devices hitherto known for paraffining thread with solid paraffin, there was little point in using large paraffin elements due to the danger of non-uniform reduction and the impossibility of ensuring uniform drive conditions for the paraffin element in the long term, these disadvantages are obviated by means of the device according to the invention. It is, therefore, advantageous to use paraffin elements which exhibit a diameter of at least 50 mm. This substantially prolongs the periods between one renewal of the paraffin element and the next which relieves the machine operators.

To enable the contact pressure between paraffin element and stop rail to be adjusted, the stop rail is advantageously adjustable parallel to the axis of the paraffin element. By this means, the angle of deflection of the yarn onto the paraffin element is modified whereby the contact pressure of the yarn, which is fixed in its path, also varies.

To permit the paraffin element to be exchanged rapidly, the stop rail is conveniently mounted pivotably out of the region in front of the end face of the paraffin element, while the stop rail advantageously exhibits a catch-thread to remove the still running thread from the region in front of the end face of the paraffin element. Additionally to or instead of the pivotable arrangement of the stop rail, it may also be provided that an elastic element is associated with the stop rail by means of which the stop rail is resiliently biased against the end face of the paraffin element. The accessibility of the paraffin element may also be improved in this manner by a simple hinging away.

The larger the paraffin element is made, the greater will be the danger of the internal profile of the paraffin element being knocked out by the tilting moment which occurs. To avoid having to exert an excessive countermoment with the stop rail, whereby the paraffin element would be reduced more rapidly, it is provided, according to a further feature of the invention, that the paraffin element is braced against a nontilting plate slidable along the polyhedral bolt, for which purpose the plate conveniently has on its side remote from the paraffin element a guide hub with an internal profile adapted to the shape of the polyhedral bolt. However, such a construction of the plate is also advantageous for the paraffin element with other constructions of stops. The stabilizing effect of the plate upon the paraffin element is further increased if, according to a further feature of the invention, this plate exhibits an annular flange slightly gripping the paraffin element at its circumference.

The object of the invention produces an extraordinarily uniform reduction of the paraffin element, since the latter is rotated permanently in a precisely fixed position. This makes it possible, for the first time, to use large paraffin elements at favorable cost, which permits more economical production of the paraffin elements and also more economical operation during paraffining.

BRIEF DESCRIPTION OF THE DRAWING

Further particulars of the invention are describe more fully with reference to the drawing, wherein.

Figure 1:
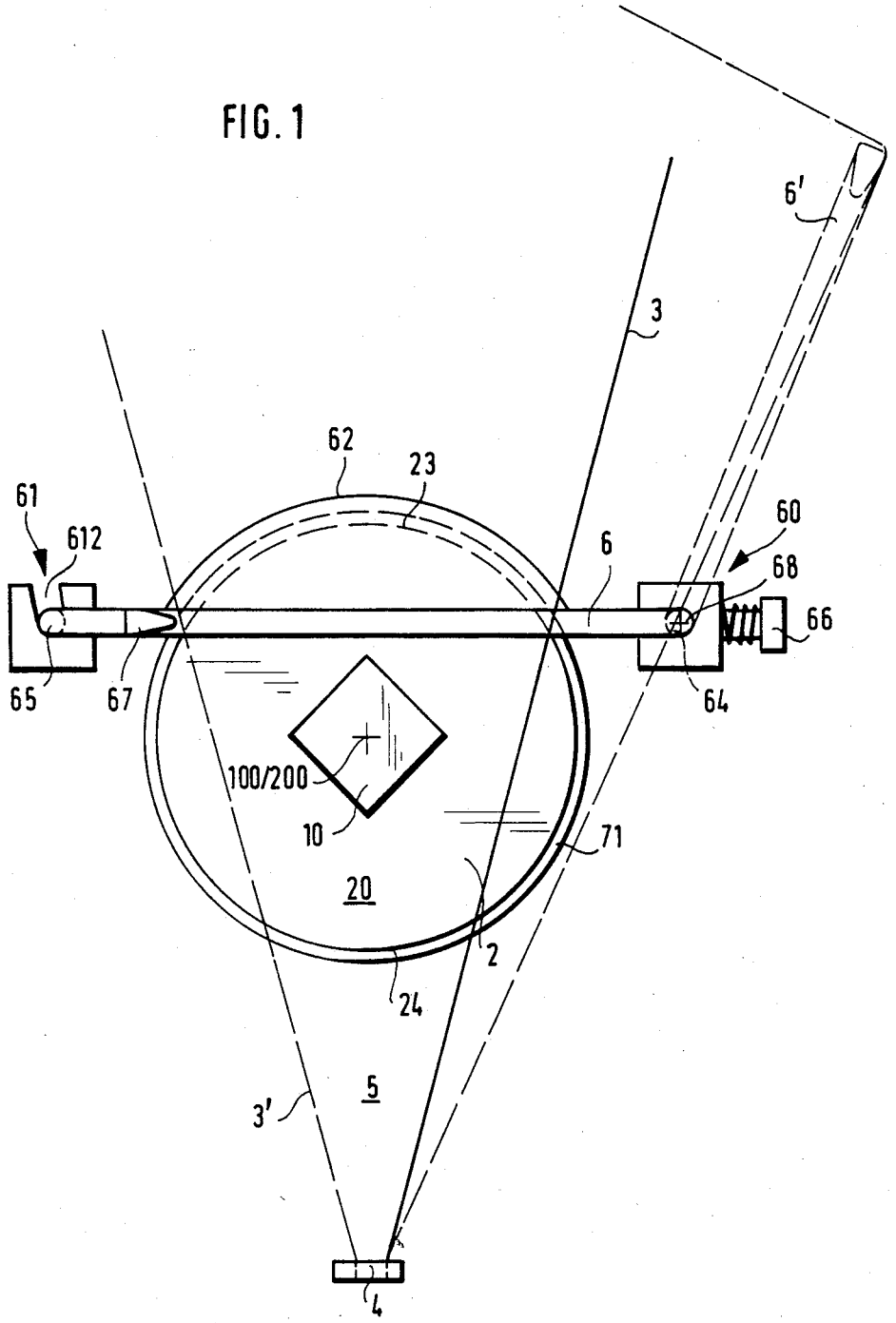
FIG. 1 shows a paraffining device constructed according to the invention in elevation.

The paraffining device, arranged in the thread path between an active or passive delivery station and a take-up device, exhibits a rotary guide mandrel constructed as a polyhedral bolt 10, which can be set in rotation by an appropriate drive device 1 (FIG. 2), for example, a motor or a transmission driven in suitable manner, and upon which a paraffin element 2 is placed. The term "active delivery station" is intended here to mean a delivery station which feeds the thread 3 positively to the paraffin element 2, for example, the spinning device of an open-end spinning apparatus. On the other hand, a passive delivery station in the sense of this description is a station from which the thread is drawn off, for example, the feed spool of a winding frame.

A thread guide 4, which may also be formed by the take-up roller pair in the case of an open-end spinning apparatus, is present upstream of the paraffin element 2 in the thread travel direction. Downstream of the paraffining device in the thread travel direction, the thread 3 is inserted into a traversing thread guide or a cross-groove roller, by which element the thread 3 is fed traversing to a spool.

During traversing, the thread 3 sweeps a triangular surface, the so-called traversing triangle 5, which is bounded by the illustrated path of the thread and by the path 3' of the thread shown by dash lines. The end face 20 of the paraffin element 2 is arranged in the traversing triangle 5 so that the paraffin element 2 overhangs the latter laterally. By this means, it is ensured that the traversing thread 3 is always in contact with the end face 20 of the paraffin element 2. A stop constructed as a stop rail 6, which limits the position of the paraffin element 2 towards the traveling thread 3, is associated with the paraffin element 2. The stop rail 6 extends transversely to the thread travel direction and is in contact with the upper half of the end face 20 of the paraffin element 2. The stop rail 6 is mounted in stationary retaining devices 60 and 61 on both sides of the paraffin element 2 in suitable manner.

Figure 3:
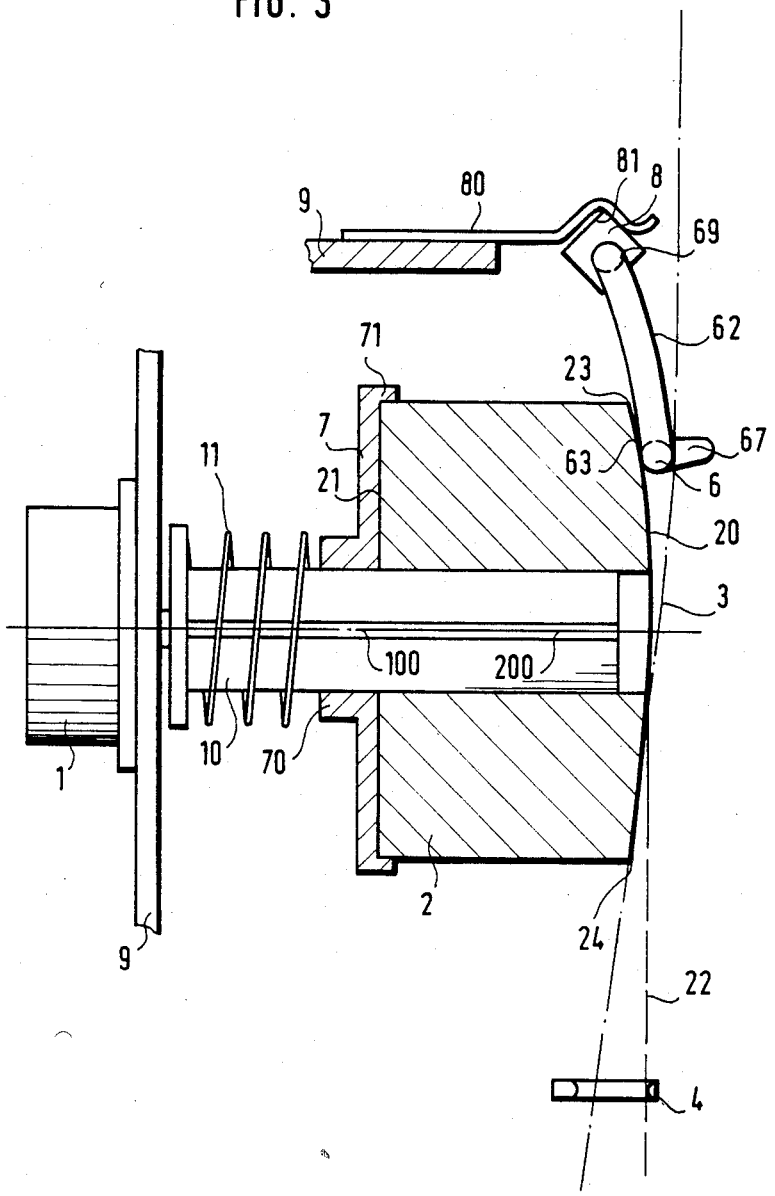
FIG. 3 shows the device shown in FIG. 1 in side elevation.

A compression spring 11, which is braced against the machine frame 9, maintains the paraffin element 2 in abutment with the stop rail 6. As FIG. 3 shows, the thread 3, along its path from the delivery device to the take-up device, is in contact with the lower half of the end face 20 of the paraffin element 2, whereas on the upper half of the end face 20 of the paraffin element 2, it is lifted from the paraffin element 2 by the stop rail 6.

During the spinning process or rewinding process, the thread 3 passes the end face 20 of the paraffin element 2, being moved in swinging reciprocation in the region of the traversing triangle 5 by the traversing device not shown (traversing thread guide or cross-groove roller). During this movement, the thread 3 is in contact with the paraffin element 2 on the feed side to the latter, whereas, on the discharge side of the paraffin element 2, it is lifted slightly from the paraffin element 2 by the stop rail 6. It is thus determined, by the thickness of the stop rail 6 chosen, over what region of length of the thread path the thread 3 is in contact with the end face 20 of the paraffin element 2.

The thread 3 is not disturbed in its traversing movement by any stops or paraffin accumulations, so that regular traversing of the thread 3 is ensured even in the region of the paraffin element 2. It is thus also possible to ensure uniform reduction of the paraffin element 2. Since it is also impossible for the thread 3 to become caught between the stop rail 6 and paraffin element 3, because the stop rail 6 extends between the thread and paraffin element 2 substantially transversely to the path of the traversing thread 3, uniform reduction of the paraffin element 2 is obtained even in the annular region 21 of the end face 20 of the paraffin element 2 in which the latter is braced against the stop rail 6.

The thread travel direction is irrelevant in principle. Whereas, in the exemplary embodiment described, the (active or passive) delivery station is located beneath the paraffin element 2 and the take-up device above the latter so that the thread 3 passes the paraffin element 2 from below upwards, an inverse thread travel direction is entirely possible. In this case, although the bracing rail 6 may continue to be in contact with the upper half of the end face 20 of the paraffin element 2, the apex of the traversing triangle 5 formed by the thread guide 4 is located above the paraffin element 2. As a result of the construction of the paraffining device, the clamping of the thread 3 in the region of the stop rail 6 is avoided and uniform reduction of the paraffin element 2 is thereby achieved. Irrespectively of the thread travel direction, it is ensured that the paraffin element 2 is in contact with the stop rail 6 by that half of its end face 20 with which the thread 3 is not in contact on the end face 20. It is thus achieved that the thread 3 exerts a pressure upon the paraffin element 2 in the one half of the end face 20, and the stop rail 6 in the other half of the end face 20, while by a suitable choice of the thread contact pressure and of the contact pressure exerted by the compression spring 11 associated with the paraffin element 2 between paraffin element 2 and stop rail 6, the moments thereby generated are largely self-compensating.

In order to obtain a particularly smooth thread travel and hence particularly uniform paraffining, it is provided in the case of the above-described paraffining device that the thread guide 4 beneath the paraffin element 2 and the stop rail 6 are constructed so that the thread is substantially in contact only with the lower half of the end face 20 of the paraffin element 2. The rotation of the paraffin element 2, therefore, always acts upon the thread 3 along the entire contact length of the thread 3 with the paraffin element 2 and in the same direction—and not in the opposite direction as is the case for greater contact lengths.

Before describing further particulars of the device according to the invention, the effect in comparison with a known paraffining device will be described with reference to FIG. 3. As FIG. 3 shows, the polyhedral bolt 10 of the present invention does not extend to the end face 20 of the paraffin element 2, so that it cannot in any circumstances come into contact with the thread 3 traversing on the end face 20, which would prevent uniform paraffining. Due to the deadweight of the paraffin element 2, it has the tendency to slope downwards on its unsupported end face 20, particularly since certain tolerances between the male profile of the polyhedral bolt 10 and the female profile of the paraffin element 2 are unavoidable. This tendency is further accentuated if the paraffin element 2 is braced on the lower half of its end face 20—as is the case of the prior art. Due to this tilting moment, the internal profile of the paraffin element 2 in known paraffining devices becomes progressively knocked out with progressively increasing speed. This results in progressive deterioration of the driving entrainment of the paraffin element 2, so that the paraffining effect ultimately bcomes totally indefinite.

Figure 2:
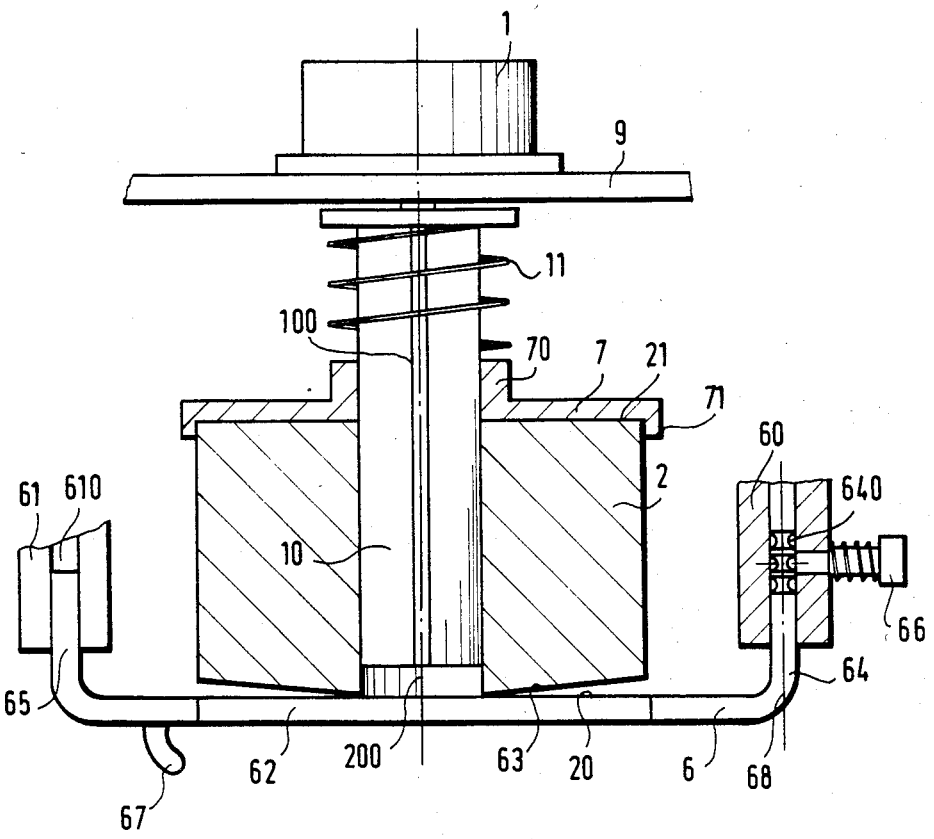
FIG. 2 shows the device shown in FIG. 1 in plan.

Not so with the device described. Here the paraffin element 2 is always braced by the stop rail 6 on that half of its end face 20 remote from the thread contact side irrespectively of the thread travel direction, so that no tilting whatever of the paraffin element can occur. The paraffin element 2 consequently always occupies such a position that its longitudinal axis 200 coincides with the axis 100 of the polyhedral bolt 10 (FIG. 2). This ensures uniform driving of the paraffin element 2 even over long periods, and leads to uniform reduction of the paraffin element 2. This is of even greater importance for open-end spinning apparatuses than for winding frames, because due to the slower takeup speed of the thread 3 compared to that on winding frames, the useful life of a paraffin element 2 on opening spinning apparatuses is several times greater than on winding frames.

Because the described device permits longer service times for the paraffin element 2, it also creates the conditions for larger dimensions of the paraffin element 2. This is also particularly advantageous, since in this way, the contact length of the thread 3 against the end face 20 of the paraffin element 2, which was somewhat shortened by the stop rail 6 extending transversely to the thread travel direction, can be lengthened again. For this purpose, the paraffin element 2 conveniently exhibits a diameter of at least 50 mm. As a result, the paraffin element 2 has, compared to customary paraffin element sizes, for example, five times the mass and more than five times the useful life.

Obviously with such large paraffin elements 2, the tilting moment is also considerably greater than with small paraffin elements 2. Even if the stop rail 6 generates an entirely adequate counter-moment, this is paid for by the disadvantage of an increased contact force and thus increased wear. To avoid the necessity of increasing this contact force compared to small paraffin elements 2, it is provided in the embodiment shown that the paraffin element 2 is braced against a plate 7 slidable along the polyhedral bolt and exhibiting on its side remote from the paraffin element 2, a guide hub 70 which exhibits an internal profile adapted to the external profile of the polyhedral bolt 10. A non-tilting sliding of the plate 7 on the polyhedral bolt 10 is thereby made possible. Because the paraffin element 2 has a tendency, due to the axial forces (compression spring 11 and stop rail 6) influencing it, to contact this plate 7 with its total base surface 21, the plate 7 reliably counteracts the tilting moment of the paraffin element 2, which is generated by its deadweight and by the polyhedral bolt 10 not extending along the total length of the paraffin element 2.

This effect of the plate 7 is substantially assisted by the longest possible contact surface for the paraffin element 2, and attains its optimum when the plate 7 exhibits at its circumference an annular flange 71 which slightly grips the paraffin element 2. In this way, the paraffin element 2 can be used for a particularly long useful life; such a non-tiltably guided plate 7 is advantageous even in paraffining devices with other stops instead of the stop rail 6 described.

It is not absolutely necessary for the plate 7 to exhibit a guide hub 70 projecting beyond the plate base towards the compression spring 11; for a corresponding thickness of the plate 7, this guide hub may also possibly be omitted if non-tilting guidance of the plate 7 is ensured.

It is advantageous in the case of large paraffin elements 2 if the stop rail 6 contacts the paraffin element 2 as gently as possible, so as to contribute to the long useful life of the latter. For this purpose, the stop rail 6 has, according to FIG. 1, an enlargement 62 on its upper side, by which it contacts the paraffin element 2. By this means, the stop surface 63 of the stop rail 6 on the paraffin element 2 is enlarged, and correspondingly, the pressure per unit area is reduced for equal total contact pressure. The enlargement 62 is obtained in a particularly simple manner by constructing the stop rail 6 with the enlargement 62 as one continuous metal sheet.

In the embodiment illustrated, the metal sheet forming the stop rail 6 and the enlargement 62 slightly overhangs the paraffin element 2 at its peripheral edge 23, so that the stop rail 6 does not exhibit an edge on its upper side in the region of the paraffin element 2.

To make it impossible for the stop rail 62 to cut into the rotating paraffin element 2, it not only exhibits rounded edges, but has a particularly constructed stop surface 63. According to FIG. 3, this stop surface 63 terminates slightly convexly towards its lower end, so that here again the possibility of an edge cutting into the end face 20 of the paraffin element 2 is effectively prevented.

Since, in any case, the end face 20 of the paraffin element 2 acquire in time, by the paraffining of the thread 3, a slightly convex shape which deviates from the plane 22 passing at right angles to the longitudinal axis 200 of the paraffin element, this effect of the stop surface 63 can also be obtained by the stop rail 6 extending downwards until it lifts off the convex end face 20 of the paraffin element 2.

Depending upon the required intensity of paraffining and upon the fiber material processed or yarn to be treated, it is advantageous if the contact pressure of the paraffin element 2 against the thread 3 can be modified. However, the plane of the traversing triangle 5 of the thread 3 is determined by the thread guide 4 and the stop rail 6 effecting a deflection of the thread. In order to modify the contact force of the thread 3 against the paraffin element 2, the latter is slid parallel to its longitudinal axis 200 so that the thread deflection at the lower peripheral edge 24 of the paraffin element 2 is also increased or decreased.

The fixing of the paraffin element 2 in its respective axial position occurs by adjusting the stop rail 6 parallel to the longitudinal axis 200 of the paraffin element 2. As FIG. 2 shows, the stop rail 6 exhibits for this purpose on each side an end 64 and 65 bent parallel to the longitudinal axis 200 of the paraffin element 2, by means of which the stop rail 6 is mounted in the retaining devices 60 and 61. The one end 64 has a plurality of serially arranged peripheral grooves 640 with which a catch bolt 66 mounted elastically in the retaining device 60 cooperates. By partially extracting the catch bolt 66, the stop rail 6 can be adjusted by one or more peripheral grooves in the one or other direction parallel to the longitudinal axis 200 of the paraffin element 2, whereafter the stop rail 6 is resecured in its new position by releasing the catch bolt 66 again. Other fixing systems are, of course, likewise possible.

As FIGS. 1 and 2 show, the mounting of the end 65 in the retaining device 61 is constructed as an upwardly open groove 610. In this manner, when it is necessary to exchange the consumed paraffin element 2 for a new one, it is unnecessary first of all to demount the stop rail 6. On the contrary, it is sufficient to pivot the stop rail 6 upwards about the bearing formed by the retaining device 61 so that the end face 20 of the paraffin element 2 is exposed. In order simultaneously to remove the thread 3 from the end face 20 of the paraffin element 2 without having to interrupt the thread take-up, the stop rail 6 in the embodiment illustrated has a catch-thread 67, which enters the region of the thread 3 sliding along the stop rail 6 and entrains it during the pivotal movement into the rest position 6'. The exchange of the paraffin element 2 is accomplished very rapidly, so that the few meters of yarn which are not paraffined meanwhile are totally insignificant to the further processing. In fact, paraffined yarn is used predominantly in various forms of knitting, where the thread 3 is passed through thread guides before reaching the stitch-forming parts. During the feed of yarn to the stitch-forming parts, a film of paraffin is deposited in the course of time, which ensures adequate slip and after-paraffining of the thread 3 in the case of unparaffined yarn sections.

It is not absolutely necessary for the pivot axis 68 of the stop rail 6 to be oriented parallel to the longitudinal axis 200 of the paraffin element 2. On the contrary, it is also possible to provide a vertical pivot axis so that the pivotal plane is arranged parallel to the longitudinal axis 200 of the paraffin element 2. Here again a catch-thread 67 may be provided, likewise the possibility of an adjustability of the stop rail 6 parallel to the longitudinal axis 200 of the paraffin element 2, in that, for example, the retaining devices 60 and 61 are mounted adjustably in this direction. It is also possible to provide the pivot axis parallel to the plane 22 passing through the end face 20 of the paraffin element 2. FIG. 3 illustrates such a variant of the device described, and shows the pivot axis 69 of the stop rail 6 above the paraffin element 2. In this case, a square 8 is present on the pivot axis 69, and engages in a notch 81 of a spring plate 80, which is in turn mounted on the machine frame 9. This spring plate 80 also produces, by its elasticity, an elastic bracing of the paraffin element 2 by the stop rail 6.

The stop rail 6 is susceptible of further variations. For example, it is possible to construct it as a thread tension compensating yoke. In the case of an appropriate guidance of the thread across the stop rail 6, the latter may assume the function of a thread tension compensating yoke, so that a separate thread tension compensating yoke becomes unnecessary.

The size of the paraffin element 2 used is in principle irrelevant to the present invention, however, its use is particularly advantageous with large diameters of 50 mm. or more.

Further variants of the object of the invention by the exchange of elements mutually or for equivalents, and combinations thereof, fall within the ambit of the present invention.

What we claim is:

1. A thread paraffining device employing a paraffin element, a thread delivery station and a thread take-up device with a thread path extending therebetween, a rotary polyhedral bolt, the axis of which is oriented substantially at right angles to said thread path between said delivery station and said take-up device, a stop, said paraffin element being resiliently biased and slidably mounted towards said thread path and said stop, the improvement comprising:

said stop being a stop rail extending transversely to the thread path direction, said stop rail engaging an area of one half of a face of said paraffin element and said thread contacting an area of the other half of said face of said paraffin.

2. The device as claimed in claim 1, wherein said stop rail exhibits an enlargement providing a contacting face in the form of a flattened area which extends from said stop rail to the edge of said paraffin element.

3. The device as claimed in claim 2, wherein said enlargement overhangs said paraffin element.

4. The device as claimed in claim 2, wherein said enlargement is inclined towards a peripheral edge of said paraffin element.

5. The device as claimed in claim 1, wherein said stop rail is rounded towards said paraffin element on its side facing said polyhedral bolt.

6. The device as claimed in claim 1, wherein said stop rail is constructed as a thread tension compensating yoke.

7. The device as claimed in claim 1, wherein said paraffin element exhibits a diameter of at least 50 mm.

8. The device as claimed in claim 1, wherein said stop rail is adjustable parallel to the longitudinal axis of the paraffin element.

9. The device as claimed in claim 1, wherein said stop rail is pivotable out of the region in front of an end face of said paraffin element.

10. The device as claimed in claim 9, wherein said stop rail exhibits a catch-thread.

11. The device as claimed in claim 1, wherein said paraffin element abuts against a non-tilting plate slidable along said polyhedral bolt.

12. The device as claimed in claim 11, wherein said plate has on its side remote from said paraffin element a guide hub with an internal profile adapted to the shape of said polyhedral bolt.

13. The device as claimed in claim 11, wherein said plate exhibits an annular flange slightly gripping said paraffin element at its circumference.

* * * * *